US005421454A

United States Patent [19]

Chern

[11] Patent Number: 5,421,454

[45] Date of Patent: Jun. 6, 1995

[54] GOLF BAG WITH INFLATABLE AIR BLADDERS

[76] Inventor: Chiou-Ming Chern, No. 516, Chung-Cheng Rd., Feng-Yuan City, Taichung Hsien, Taiwan, Prov. of China

[21] Appl. No.: 297,259

[22] Filed: Aug. 26, 1994

[51] Int. Cl.[6] ..... A63B 55/06

[52] U.S. Cl. ..... 206/315.6; 206/522

[58] Field of Search ..... 206/315.3, 315.6, 522; 383/3; 137/223

[56] References Cited

U.S. PATENT DOCUMENTS

| | | | |
|---|---|---|---|
| 3,534,795 | 10/1970 | Wiedenmeier | 706/315.6 |
| 4,664,382 | 5/1987 | Palmer et al. | 206/315.6 X |
| 4,768,650 | 9/1988 | Chancellor, Jr. | 206/315.6 X |
| 4,881,638 | 11/1989 | Cho | 206/315.3 |
| 5,141,107 | 8/1992 | Wiedermann et al. | 383/3 X |
| 5,303,888 | 4/1994 | Seop | 206/315.6 X |
| 5,351,830 | 10/1994 | Bender et al. | 206/522 X |

*Primary Examiner*—Allan N. Shoap
*Assistant Examiner*—Christopher J. McDonald
*Attorney, Agent, or Firm*—Willian Brinks Hofer Gilson & Lione

[57] ABSTRACT

A golf bag has an opening at an upper end thereof and includes several horizontal tube units secured in the opening of the bag, several spacer cloth units hung respectively on the tube units so as to divide the interior space of the bag into several chambers, and a fixing unit including several inflatable air bladders attached respectively to the tube units and located in the opening of the bag. The fixing unit further includes an air pump member having an end portion equipped with a check valve through which air can enter into the air pump member, a piping intercommunicating the other end portion of the air pump member and all of the air bladders, and a pressure relief valve interposed between the air pump member and the piping and capable of being actuated to permit escape of air from the fixing unit.

4 Claims, 6 Drawing Sheets

GOLF BAG WITH INFLATABLE AIR BLADDERS

BACKGROUND OF THE INVENTION

1. Field of The Invention

This invention relates to a golf bag, more particularly to a golf bag which is equipped thereon with several inflatable air bladders that can be filled with air therein so as to clamp golf clubs tightly between the air bladders, thereby fixing the golf clubs in the bag.

2. Description of the Related Art

Referring to FIG. 1, a conventional golf bag 10 has two horizontal metal tubes 11 which cross each other and which are secured in the bag 10, and two spacer cloth units 13 which are secured on the metal tubes 11 respectively so as to divide the interior space 12 of the bag 10 into four chambers 14 in order to locate a golf equipment 20 therewithin. The golf equipment 20 includes a short club 21 and a long club 22 which are located in one of the chambers 14. It is noted that each of the chambers 14 is not provided with a golfclub retaining element therewithin. Therefore, the golf equipment 20 is usually damaged due to impact among the clubs 21, 22 or with the bag 10 when the bag 10 is carried by the user.

SUMMARY OF THE INVENTION

The main objective of this invention is to provide a golf bag which is capable of fixing a golf equipment therewithin so as to prevent damage to the equipment when the bag is carried by the user.

According to this invention, a golf bag has an opening at an upper end thereof and includes several horizontal tube units secured in the bag near the opening, several spacer cloth units hung respectively on the tube units so as to divide an interior space confined by the bag into several chambers, and a fixing unit including several inflatable air bladders which are attached respectively to the tube units and which are located in the opening. Each of the air bladders has an air intake so as to fill the air bladders with air through the air intakes.

The fixing unit further includes an air pump member having an end portion equipped with a check valve through which air can enter into the air pump member, a piping intercommunicating the other end portion of the air pump member and all of the air bladders, and a pressure relief valve which is interposed between the air pump member and the piping and which is capable of being actuated to permit escape of air from the fixing unit. Accordingly , the air bladders can be inflated by compressing the air pump member.

The pressure relief valve is generally T-shaped and includes a tubular section intercommunicating the air pump member and the piping, a valve tube secured communicatively to the tubular section and having an exhaust hole formed through a wall of the valve tube, a popper valve element disposed slidably within the valve tube, a spring biasing the peripheral surface of the popper valve element to close the inner end of the exhaust hole so as to prevent escape of air from the pressure relief valve through the exhaust hole, and a rotary knob installed on the valve tube and rotatable to move the poppet valve element in the valve tube so as to permit escape of air from the pressure relief valve. As a result, the air bladders can be deflated by actuating the rotary knob.

Each of the air bladders includes an expandable bladder body with an air chamber, a tubular stem having a first end and a second end which is secured to the bladder body and which is communicated with the air chamber of the bladder body, and a tubular fitting which is made of rubber and which intercommunicates the piping and the air bladders. The piping has several branch pipes each of which has an open end. Each fitting includes two enlarged ends which are respectively press fitted within the open end of one of the branch pipes of the piping and a first end of the tubular stem of one of the air bladders.

BRIEF DESCRIPTION OF THE DRAWING

Other features and advantages of the present invention will become apparent in the following detailed description of the preferred embodiments, with reference to the accompanying drawings, in which.

DETAILED DESCRIPTION OF THE PREFERRED EMBODIMENT

Figure 1:
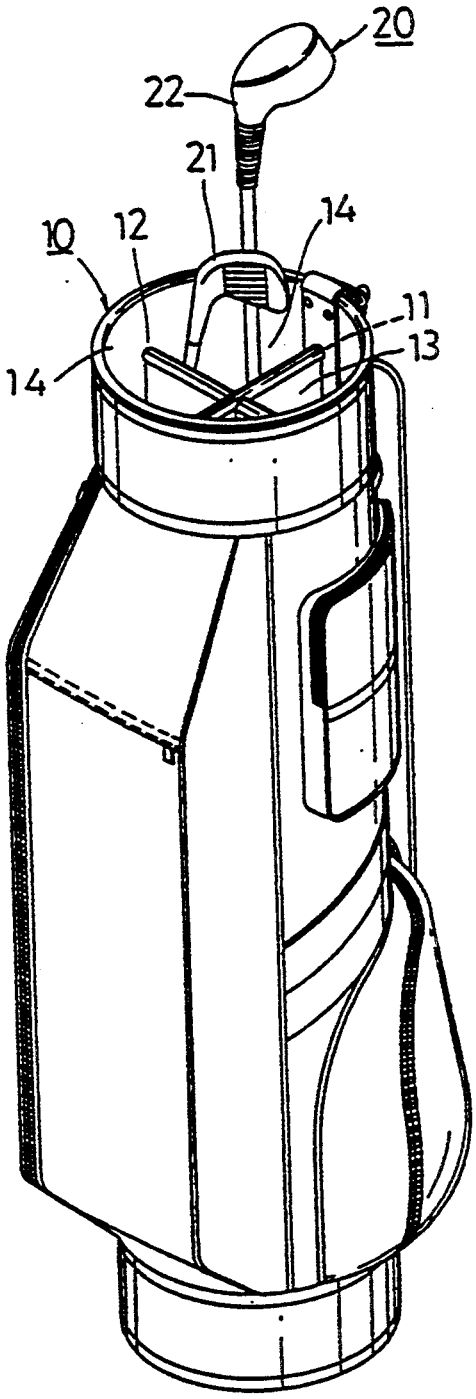
FIG. 1 PRIOR ART
FIG. 1 is a perspective view showing a conventional golf bag.
Figure 2:
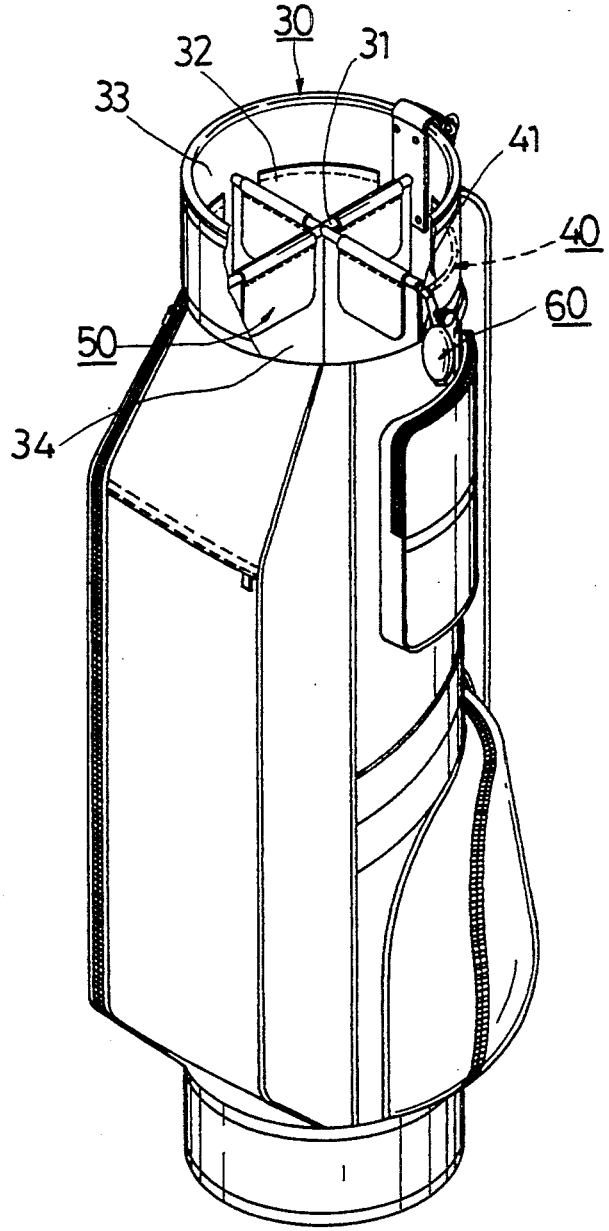
FIG. 2 is a perspective view of a golf bag according to this invention, in which a portion is removed for clarity.
Figure 5:
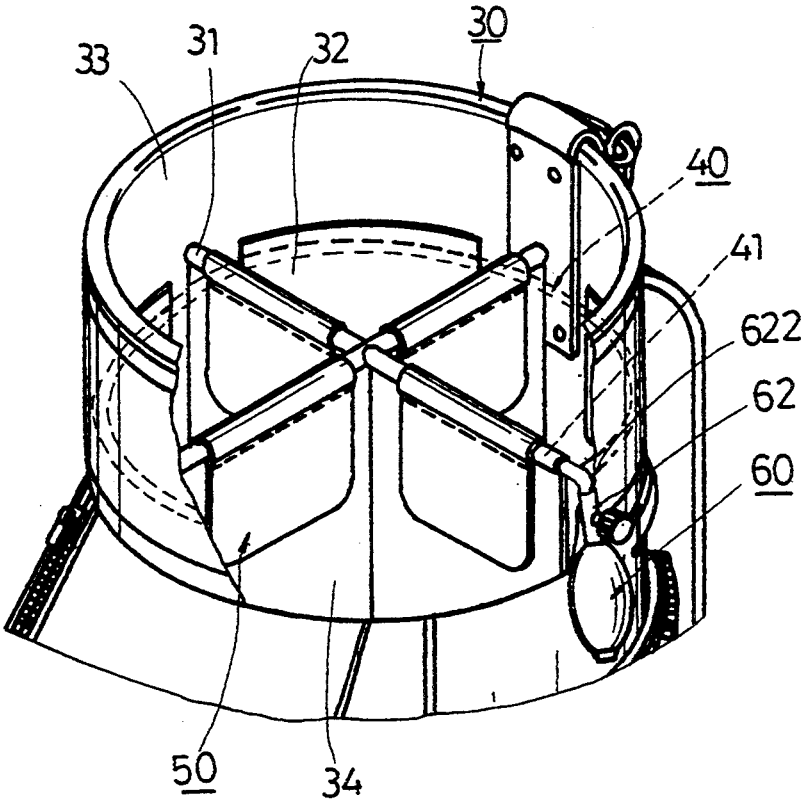
FIG. 5 is a schematic view illustrating the structure of the upper end portion of the golf bag according to this invention.

Referring to FIGS. 2 and 5, a golf bag 30 has an opening 33 in the upper end thereof and includes several horizontal tube units 31 made of metal and secured in the opening 33 of the bag 30, several spacer cloth units 34 hung respectively on the tube units 31 so as to divide an interior space confined by the bag 30 into several chambers 32, and a fixing unit including several inflatable air bladders 50 attached respectively to the tube units 31 and located in the opening 33 of the bag 30.

Figure 3:
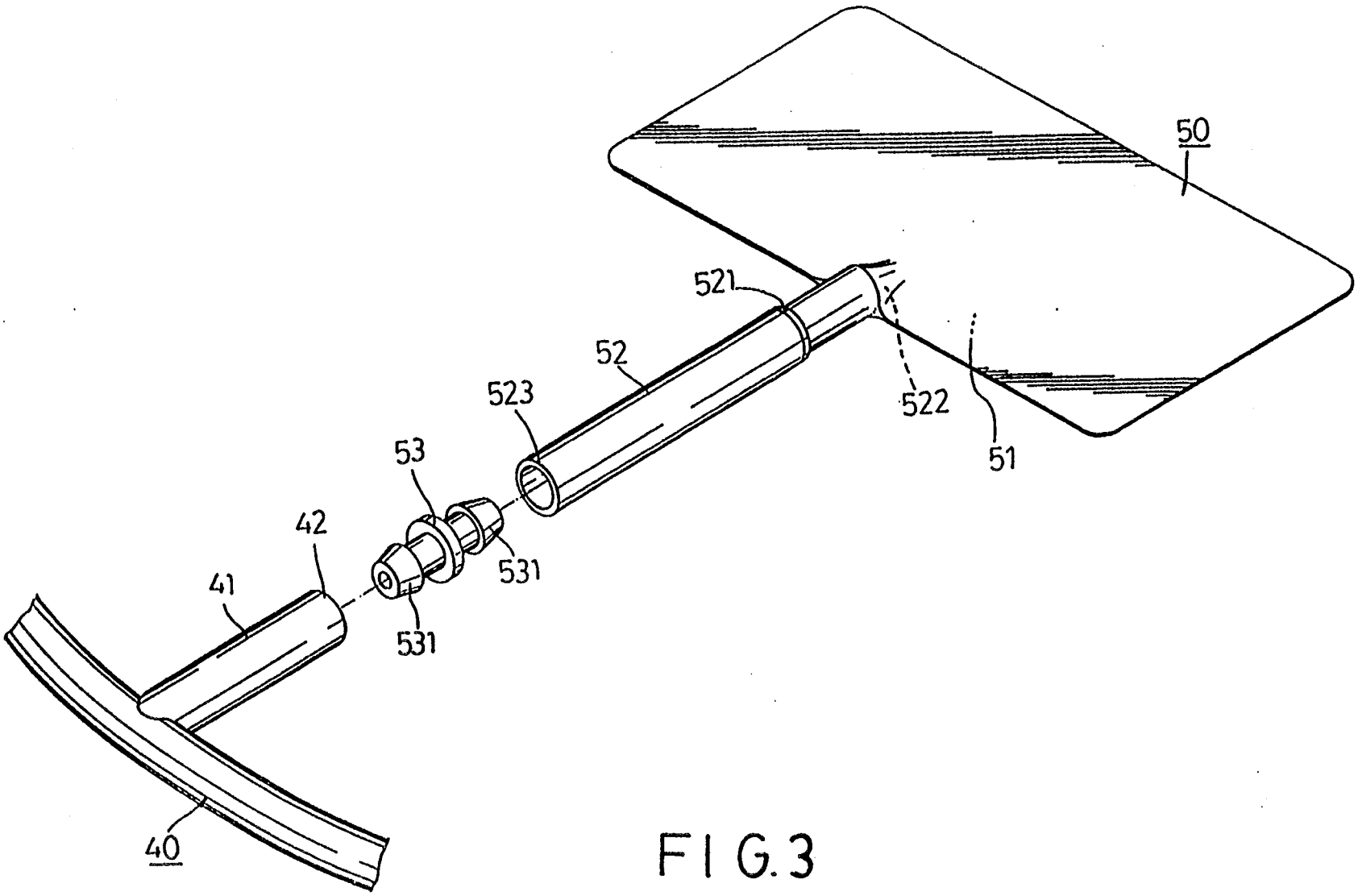
FIG. 3 is an exploded view showing an inflatable air bladder, a tubular fitting, and a branch pipe of the piping of the golf bag according to this invention.

As best shown in FIG. 3, each of the air bladders 50 has an air intake 522 so as to fill the air bladders 50 with air.

Figure 4:
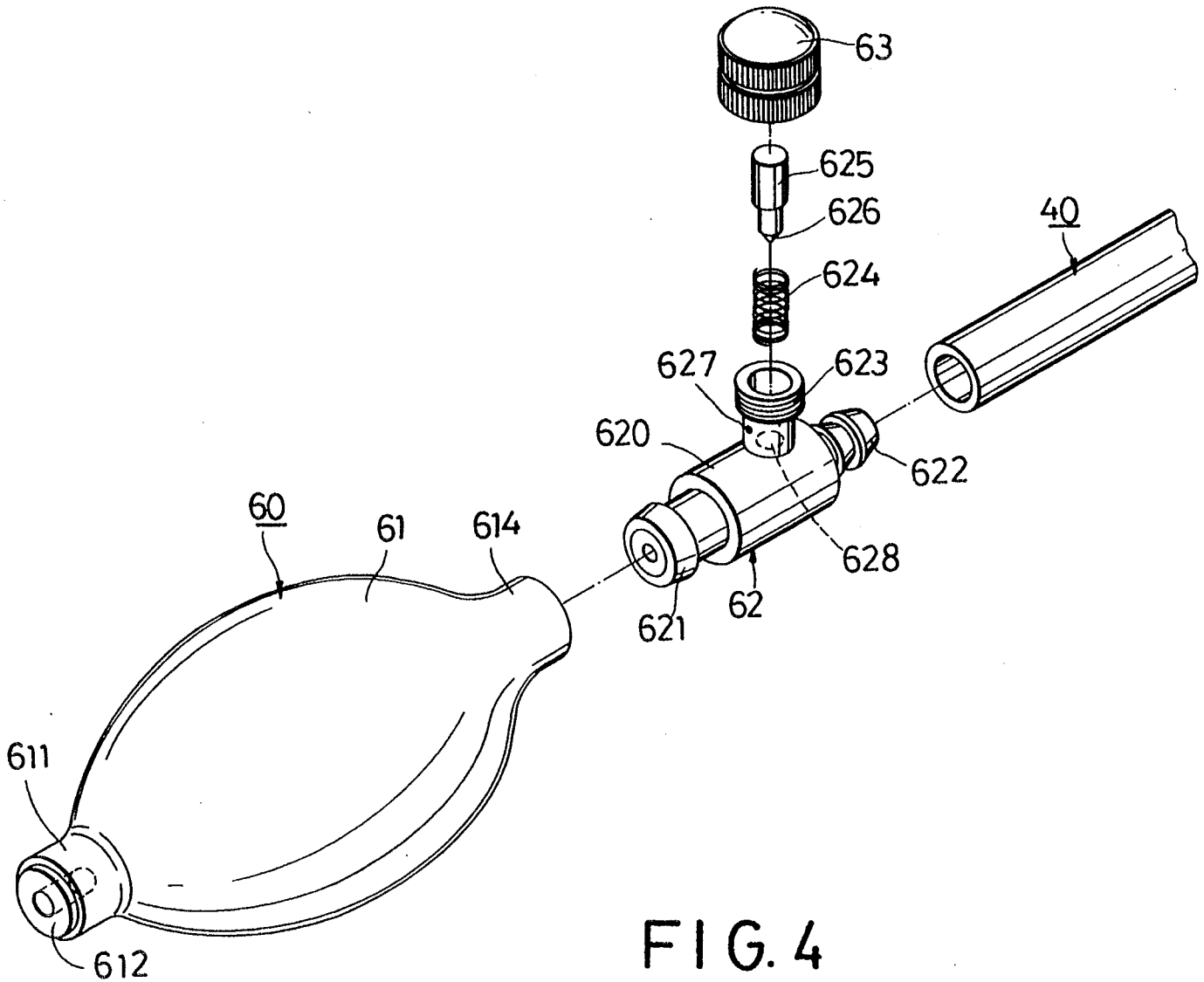
FIG. 4 is an exploded view showing a pressure relief valve and an air pump member of the golf bag according to this invention.

Referring to FIG. 4, the-fixing unit further includes an air pump member 60 having an end portion 611 equipped with a check valve 612 through which air can enter into the air pump member 60, and a piping 40 intercommunicating a pressure relief valve 62 and all of the air bladders 50 (see FIG. 3). The pressure relief valve 62 is interposed between the right end portion 614 of the air pump member 60 and the piping 40, and is capable of being actuated to permit escape of air from the fixing unit. Accordingly, the air bladders 50 can be inflated by compressing the air pump member 60. The pressure relief valve 62 is generally T-shaped and includes a tubular section 620 which has an enlarged-diameter left end portion 621 communicated with the end portion 614 of the air pump member 60, and an enlarged-diameter right end portion 622 communicated with the piping 40. A valve tube 623 is secured communicatively to the tubular section 620 and has an exhaust hole 627 formed through a wall of the valve tube 623. A poppet valve element 625 has a tapered lower end 626 which is disposed slidably within the valve tube 620 and which extends through the hole 628. A spring 624 biases the peripheral surface of the poppet valve element 625 to close the inner end of the exhaust hole 627 so as to prevent escape of air from the pressure relief valve 62 through the exhaust hole 627. A rotary knob 63 is installed on the valve tube 623 and is rotatable to move the poppet valve element 625 in the valve tube 623 so as to permit escape of air from the pressure relief valve 62. Therefore, the air bladders 50 (see FIG. 5) can be deflated by actuating the rotary knob 63.

Referring again to FIG. 3, each of the air bladders 50 includes an expandable bladder body 51 with an air chamber (not shown), a tubular stem 52 having a first end portion 523 and a second end portion 521 which is secured to the bladder body 51 and which is communicated with the air chamber of the bladder body 51, and a tubular fitting 53 which is made of rubber and which intercommunicates the piping 40 and the air bladders 50. The piping 40 has several branch pipes 41 each of which has an open end 42. Each of the fittings 53 includes two enlarged ends 531 which are respectively fitted within the open end 42 of the corresponding branch pipe 41 of the piping 40 and the first end portion 523 of the tubular stem 52 of one of the air bladders 50.

Figure 6:
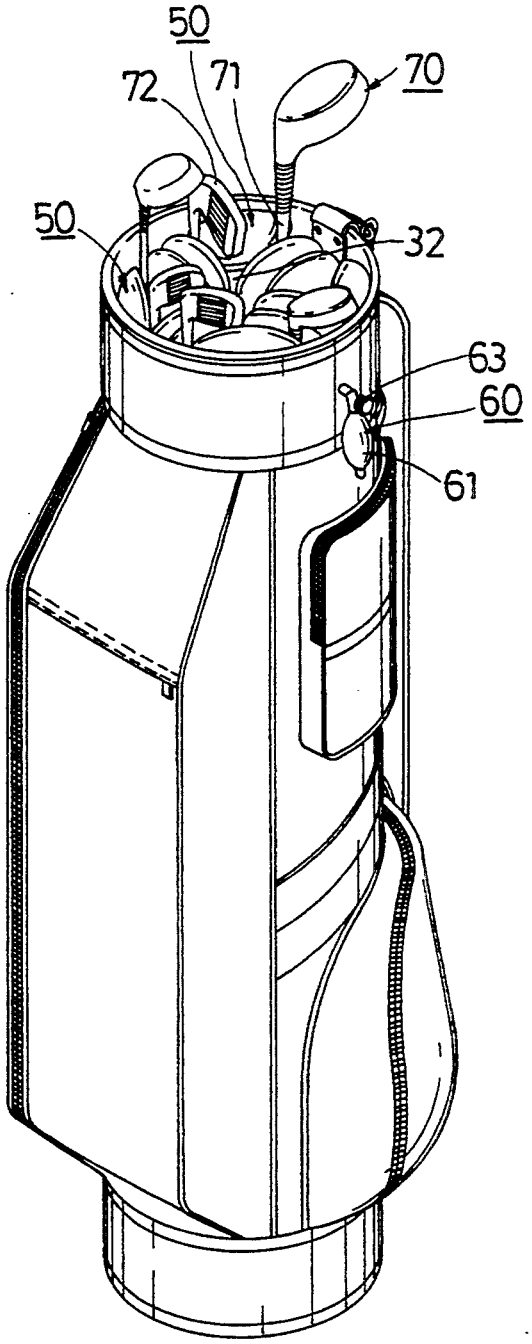
FIG. 6 is a schematic view illustrating the golf bag according to this invention when in use.

Referring to FIG. 6, a golf equipment 70 includes a long club 71 and a short club 72 which are located in one of the chambers 32 of the bag 30. The short 72 and long 71 clubs are held by the inflatable air bladders 50 which have been filled with air.

While the present invention has been described in connection with what is considered the most practical and preferred embodiments, it is understood that this invention is not limited to the disclosed embodiment but is intended to cover various arrangements included within the spirit and scope of the broadest interpretations and equivalent arrangements.

I claim:

1. A golf bag having an opening at an upper end thereof and comprising:

several horizontal tube units secured in said opening of said bag;

several spacer cloth units hung respectively on said tube units so as to divide an interior space of said bag into several chambers; and a fixing unit including several inflatable air bladders attached respectively to said tube units and located in the opening of said bag, each of said air bladders having an air intake so as to fill said air bladders with air through said air intakes.

2. A golf bag as claimed in claim 1, wherein said fixing unit further includes an air pump member having an end portion equipped with a check valve through which air can enter into said air pump member, a piping intercommunicating the other end portion of said air pump member and all of said air bladders, and a pressure relief valve interposed between said air pump member and said piping and capable of being actuated to permit escape of air from said fixing unit, whereby, said air bladders can be inflated by compressing said air pump member.

3. A golf bag as claimed in claim 2, wherein said pressure relief valve is generally T-shaped and includes a tubular section intercommunicating said air pump member and said piping, a valve tube secured communicatively to said tubular section and having an exhaust hole formed through a wall of said valve tube, a poppet valve element disposed slidably within said valve tube, a spring biasing a peripheral surface of said poppet valve element to close an inner end of said exhaust hole so as to prevent escape of air from said pressure relief valve through said exhaust hole, and a rotary knob installed on said valve tube and rotatable to move said poppet valve element in said valve tube so as to permit escape of air from said pressure relief valve, whereby said air bladders can be deflated by actuating said rotary knob.

4. A golf bag as claimed in claim 2, wherein each of said air bladders includes an expandable bladder body with an air chamber, a tubular stem having a first end and a second end which is secured to said bladder body and which is communicated with said air chamber of said bladder body, and a tubular fitting which is made of rubber and which intercommunicates said piping and said air bladders, said piping having several branch pipes each of which has an open end, each said fitting including two enlarged ends which are respectively press fitted within said open end of one of said branch pipes of said piping and a first end of said tubular stem of one of said air bladders.

* * * * *